US005788351A

United States Patent [19]

Prunty et al.

[11] Patent Number: 5,788,351

[45] Date of Patent: Aug. 4, 1998

[54] CAM FOR VERTICAL ADJUSTMENT OF APPLIANCE DOORS

[76] Inventors: Jeffrey L. Prunty, 7423 Fox Ct. NorthEast, Cedar Rapids, Iowa 52402; James M. Grace, 3206 "X" Ave., Elberon, Iowa 52225-8796; Ronald E. Haltmeyer, 2770 Lakeview Dr. NE., Solon, Iowa 52333

[21] Appl. No.: 654,367

[22] Filed: May 30, 1996

[51] Int. Cl.[6] ..... A47B 96/00

[52] U.S. Cl. ..... 312/326; 312/405; 312/329; 16/235; 16/243; 16/DIG. 34; 49/388

[58] Field of Search ..... 312/326, 329, 312/294, 296, 405, 407; 16/235, 236, 242, 243, DIG. 34; 49/381, 388

[56] References Cited

U.S. PATENT DOCUMENTS

| | | | |
|---|---|---|---|
| 2,975,013 | 3/1961 | Wallace et al. | 16/235 X |
| 4,037,732 | 7/1977 | Orlando et al. | 414/662 |
| 4,735,062 | 4/1988 | Woolley et al. | 312/407 X |
| 4,932,729 | 6/1990 | Thompson et al. | 312/405 |
| 5,095,583 | 3/1992 | Prevot | 16/243 |
| 5,152,102 | 10/1992 | La See | 16/235 X |
| 5,265,954 | 11/1993 | Keil | 312/326 X |
| 5,579,606 | 12/1996 | Kim | 312/405 X |

FOREIGN PATENT DOCUMENTS

| | | | |
|---|---|---|---|
| 618395 | 4/1961 | Canada | 16/243 |
| 8817 | 6/1890 | United Kingdom | 16/243 |
| 2061375 | 5/1981 | United Kingdom | 16/243 |
| 2121101 | 12/1983 | United Kingdom | 16/235 |

*Primary Examiner*—Peter M. Cuomo
*Assistant Examiner*—James O. Hansen
*Attorney, Agent, or Firm*—Marshall, O'Toole, Gerstein, Murray & Borun

[57] ABSTRACT

A cam adjustment apparatus facilitates vertical adjustment of an appliance door. The apparatus includes a support bracket which is arranged to support the appliance door on an appliance, and a cam which abuts the support bracket so that, as the cam is moved, the vertical position of the appliance door is adjusted. The support bracket has a pair of holes for receiving a corresponding pair of fasteners in order to fasten the support bracket to the appliance. The holes are elongated to accommodate movement of the support bracket as the cam is moved.

21 Claims, 9 Drawing Sheets

CAM FOR VERTICAL ADJUSTMENT OF APPLIANCE DOORS

TECHNICAL FIELD OF THE INVENTION

The present invention is directed to the vertical adjustment of appliance doors.

BACKGROUND OF THE INVENTION

Appliances, such as refrigerators, ovens, dish washers, clothes washers, and clothes dryers, typically have an appliance cabinet, which contains an appliance space in which articles may be cooled, heated, washed, and/or dried, and one or more appliance doors through which access may be gained to the appliance space. In such appliances, and particularly those having side-by-side appliance doors, the appliance doors must be aligned with one another. Although appliance doors are generally aligned when the appliance leaves the factory, these appliance doors can subsequently become misaligned during shipment, during removal and subsequent reattachment of the appliance doors and hinges while the appliance is being installed, and/or because of unevenness of the floor upon which the appliance is installed.

When side-by-side appliance doors are misaligned with respect to one another, the door handles and trim pieces of the appliance doors are offset. Also, when the door of a single door appliance is misaligned, the door does not appear plumb to the appliance cabinet. This misalignment is easily noticeable and results in dissatisfied customers. Realignment of the appliance doors requires a service call which is costly for the manufacturer.

The present invention is directed to a cam adjustment apparatus which may be used to adjust the vertical position of an appliance door in a simple and straightforward manner. Accordingly, by using the present invention, appliance doors of an appliance may be easily aligned during installation of the appliance at a customer's facility.

SUMMARY OF THE INVENTION

According to a first aspect of the present invention, an apparatus comprises a support and a cam. The support is arranged to support an appliance door. The cam abuts the support and is arranged to adjust a position of the support.

According to another aspect of the present invention, an appliance, which has an appliance door that may be vertically adjusted with respect to an appliance cabinet, comprises an appliance cabinet, an appliance door, a supporting means, and a cam. The appliance door has a vertical position with respect to the appliance cabinet. The supporting means supports the appliance door on the appliance cabinet. The cam abuts the supporting means, and the cam is arranged to adjust the vertical position of the appliance door with respect to the appliance cabinet.

According to yet another aspect of the present invention, an apparatus, which facilitates adjustment of an appliance door with respect to an appliance cabinet, comprises a support bracket, a cam, and an attachment mechanism. The support bracket is arranged to support an appliance door. The cam abuts the support bracket, and the cam is arranged to adjust the support bracket as the cam is moved so that a position of an appliance door is adjusted. The attachment mechanism is arranged to attach the cam to an appliance cabinet so as to permit the cam to move and so as to permit the cam to adjust an appliance door with respect to its appliance cabinet.

BRIEF DESCRIPTION OF THE DRAWINGS

These and other features and advantages of the present invention will become more apparent from a detailed consideration of the invention when taken in conjunction with the drawings in which.

DETAILED DESCRIPTION

Figure 1:
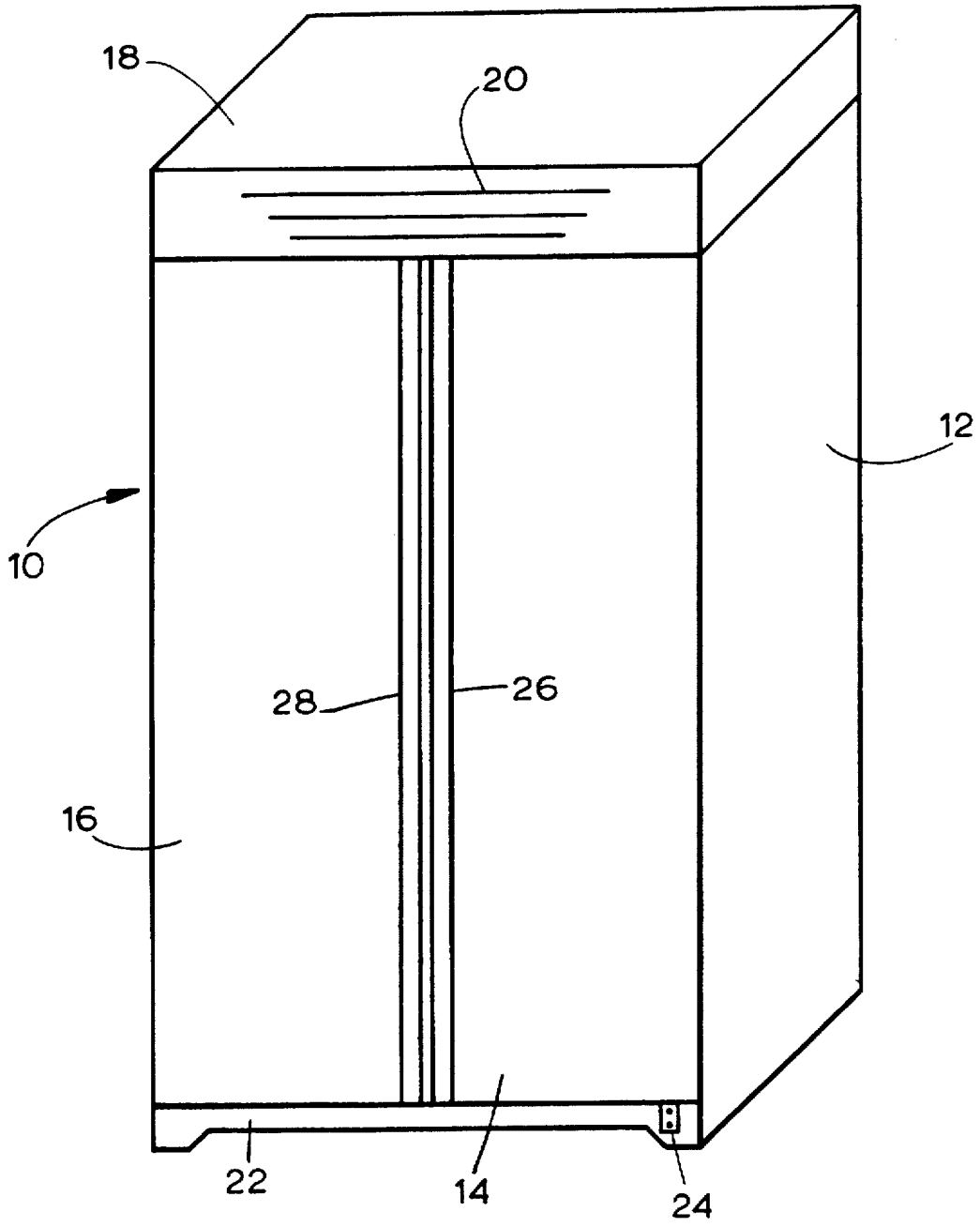
FIG. 1 an isometric view of an appliance having appliance doors at least one of which may be adjusted vertically by the present invention.

As shown in FIG. 1, an appliance 10, which may be in the form of a refrigerator having side-by-side appliance doors, includes an appliance cabinet 12 containing internal compartments such as a freezer compartment and a fresh food compartment. The appliance 10 also has a first appliance door 14 and a second appliance door 16. For example, the first appliance door 14 provides access to the fresh food compartment, and the second appliance door 16 provides access to the freezer compartment.

The appliance 10 further includes a cover 18 which forms an enclosure containing a compressor, a condenser fan, a condenser coil, and a control box. The cover 18 may have vent openings 20 which allows circulation of air within the enclosure formed by the cover 18.

A footer 22 supports the appliance 10 on a floor. Accordingly, the footer 22 is rigidly attached to the appliance cabinet 12. A cam adjustment apparatus 24 is affixed to the footer 22 in such a way as to permit vertical adjustment of the first appliance door 14 with respect to the second appliance door 16. The first appliance door 14 may have a trim piece 26 which forms a handle for the first appliance door 14, and the second appliance door 16 may have a trim piece 28 which forms a handle for the second appliance door 16.

Figure 2:
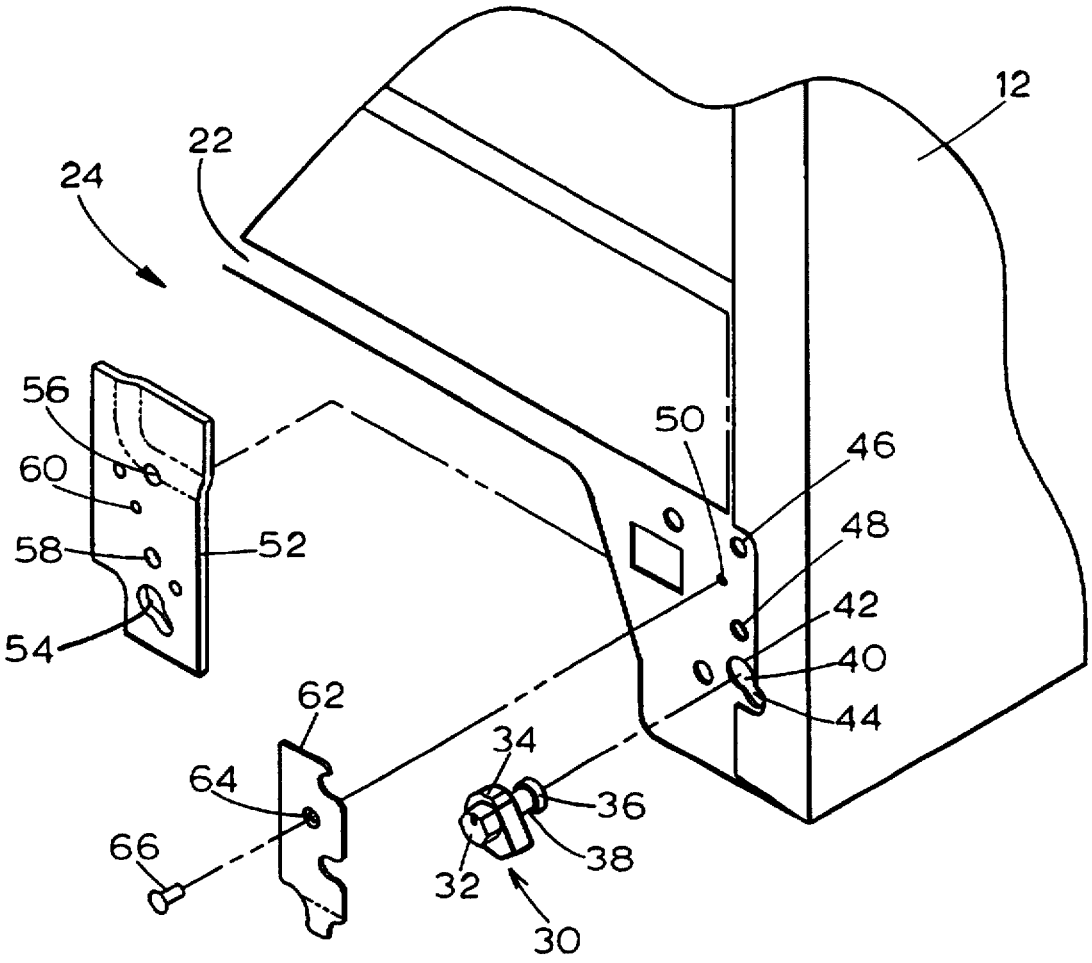
FIG. 2 is an exploded isometric view of a portion of a cam adjustment apparatus according to the present invention, wherein the cam adjustment apparatus is arranged to vertically adjust one of the appliance doors shown in FIG. 1 and includes an adjustment cam.
Figure 3:
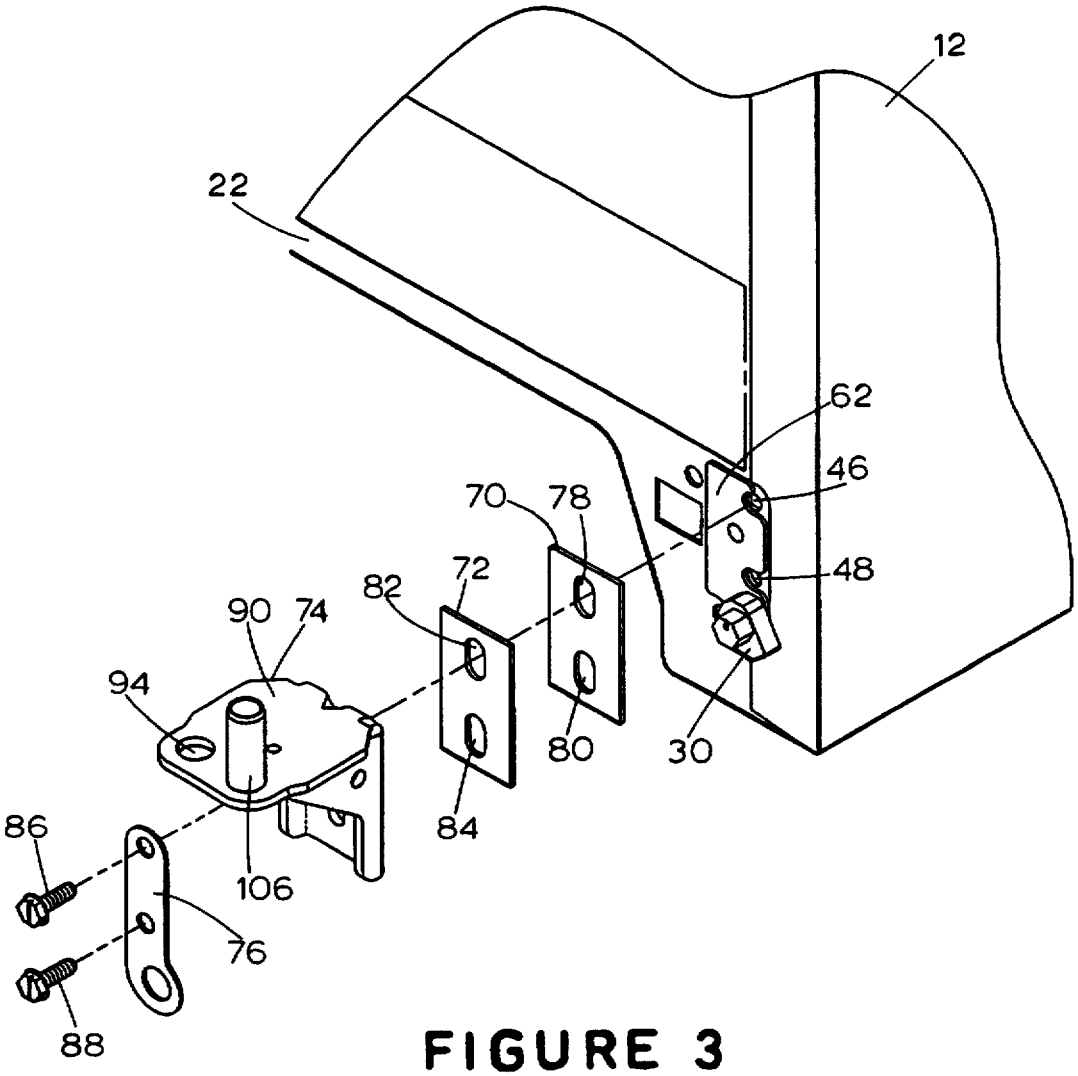
FIG. 3 is an exploded isometric view of a further portion of the cam adjustment apparatus which includes a support bracket.
Figure 8:
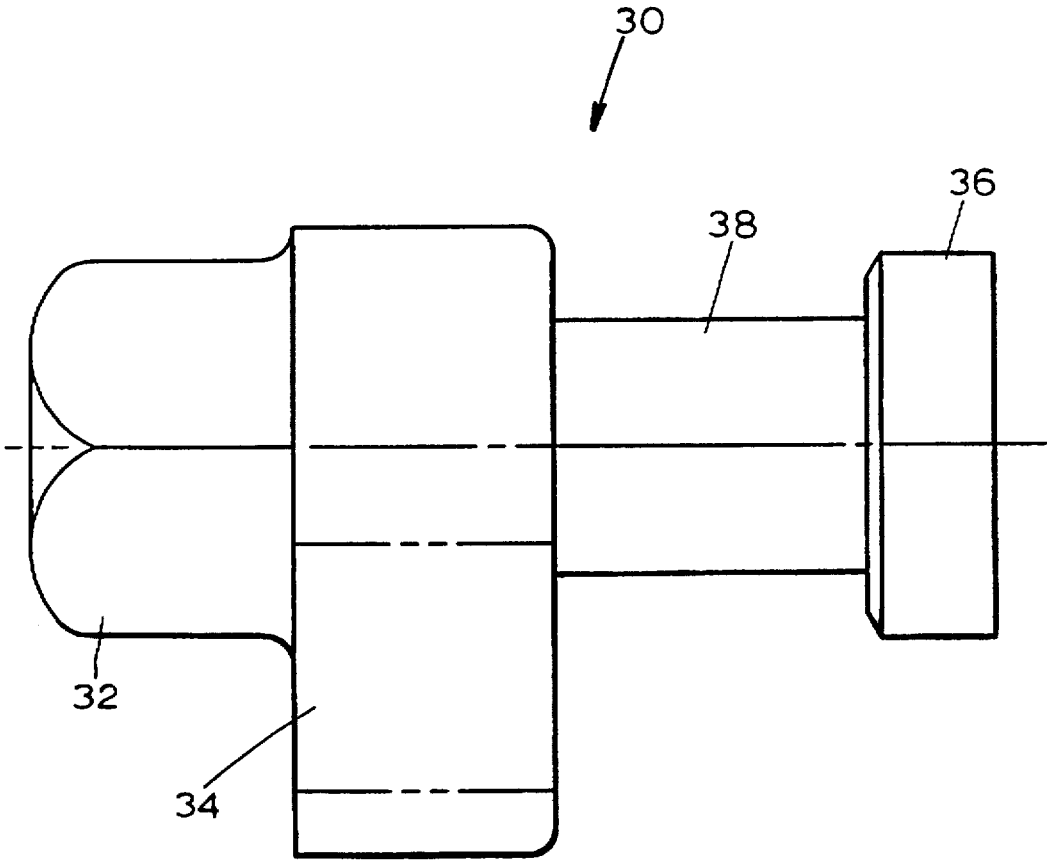
FIG. 8 is a side view of the adjustment cam shown in FIG. 2.

The cam adjustment apparatus 24 is shown in more detail in FIGS. 2 and 3. (As shown in FIGS. 2 and 3, the first appliance door 14 has not yet been mounted to the appliance cabinet 12.) The cam adjustment apparatus 24 includes a cam 30 having (i) an adjustment head 32, which may be in the form of a hexagonal bolt head, (ii) a cam surface 34, which may have a plurality of cam facets corresponding to a plurality of vertical positions of the first appliance door 14 with respect to the appliance cabinet 12, (iii) a shoulder 36, and (iv) a cam shaft 38. As shown in FIGS. 2 and 8, the adjustment head 32 and the cam surface 34 are formed at a first end of the cam shaft 38, and the shoulder 36 is formed at a second end of the cam shaft 38. The cam 30 may be one piece and may be formed, for example, by die casting or milling.

As shown in FIG. 2, the footer 22 includes a key slot 40 having a shoulder receiving opening 42 and a shoulder retaining opening 44. The footer 22 also has a pair of fastener receiving holes 46 and 48 and a pop rivet receiving hole 50.

A tap plate 52 includes a key slot 54 having a configuration substantially identical to the configuration of the key slot 40. The tap plate 52 also includes a pair of fastener receiving holes 56 and 58, and a pop rivet receiving hole 60.

During assembly of the cam 30 to the footer 22, the tap plate 52 is positioned behind the footer 22 so that the fastener receiving holes 46 and 48 of the footer 22 align with the fastener receiving holes 56 and 58 of the tap plate 52, so that the key slot 40 of the footer 22 aligns with the key slot 54 of the tap plate 52, and so that the pop rivet receiving hole 50 of the footer 22 aligns with the pop rivet receiving hole 60 of the tap plate 52. Then, a shim plate 62 having a pop rivet receiving hole 64 is placed on the front of the footer 22, and a pop rivet 66 is popped through the pop rivet receiving hole 64 of the shim plate 62, the pop rivet receiving hole 50 of the footer 22, and the pop rivet receiving hole 60 of the tap plate 52. Accordingly, the shim plate 62 and the tap plate 52 are held tightly to the footer 22.

Thereafter, the shoulder 36 of the cam 30 is inserted through the shoulder receiving opening 42 of the key slot 40 of the footer 22 and a corresponding shoulder receiving opening of the key slot 54 of the tap plate 52. When the shoulder 36 clears these shoulder receiving openings of the key slot 40 and the key slot 54, the cam 30 is slid along the key slots 40 and 54 so that the cam shaft 38 enters the shoulder retaining opening 44 of the key slot 40 and the corresponding shoulder retaining opening of the key slot 54 until movement of the cam 30 is stopped by the key slots 40 and 54.

At this point, the shoulder 36 of the cam 30, which is larger than both the shoulder receiving opening 42 of the key slot 40 of the footer 22 and the corresponding shoulder receiving opening of the key slot 54, holds the cam 30 to the footer 22. The distance along the cam shaft 38 between the cam surface 34 and the shoulder 36 may be made approximately equal to the thickness of the tap plate 52 plus the thickness of the footer 22 plus the thickness of the shim plate 62 so that the cam 30 is wedged snugly into the key slots 40 and 54 but not so snugly as to prevent rotation of the cam 30.

As shown in FIG. 3, the cam adjustment apparatus 24 further includes a pair of washer plates 70 and 72, a support bracket 74, and a plate 76. The washer plate 70 has a pair of elongated holes 78 and 80, and the washer plate 72 likewise has a pair of elongated holes 82 and 84. As will be discussed hereinafter, the support bracket 74 also has a pair of elongated holes which correspond to the elongated holes 78 and 80 of the washer plate 70 and the elongated holes 82 and 84 of the washer plate 72.

The support bracket 74 is applied to the footer 22 using a pair of fasteners 86 and 88 which are inserted, in order, through corresponding holes in the plate 76, corresponding elongated holes in the support bracket 74 (described hereinbelow), the elongated holes 82 and 84 of the washer plate 72, the elongated holes 78 and 80 of the washer plate 70, the fastener receiving holes 46 and 48 of the footer 22, and the fastener receiving holes 56 and 58 of the tap plate 52. Accordingly, the plate 76, the support bracket 74, the washer plate 72, and the washer plate 70 are fastened to the footer 22. Because the fasteners 86 and 88 are shown as screws, this fastening of the plate 76, the support bracket 74, and the washer plates 70 and 72 to the footer 22 may be accomplished by interaction between the threads of the fasteners 86 and 88 and the fastener receiving holes 46 and 48 of the footer 22. However, the fasteners 86 and 88 may be bolts so that the fastening of the plate 76, the support bracket 74, and the washer plates 70 and 72 to the footer 22 is accomplished by nuts threaded onto the ends of the fasteners 86 and 88. When the support bracket 74 is so installed, it rests upon the top most cam facet of the cam surface 34.

Figure 4:
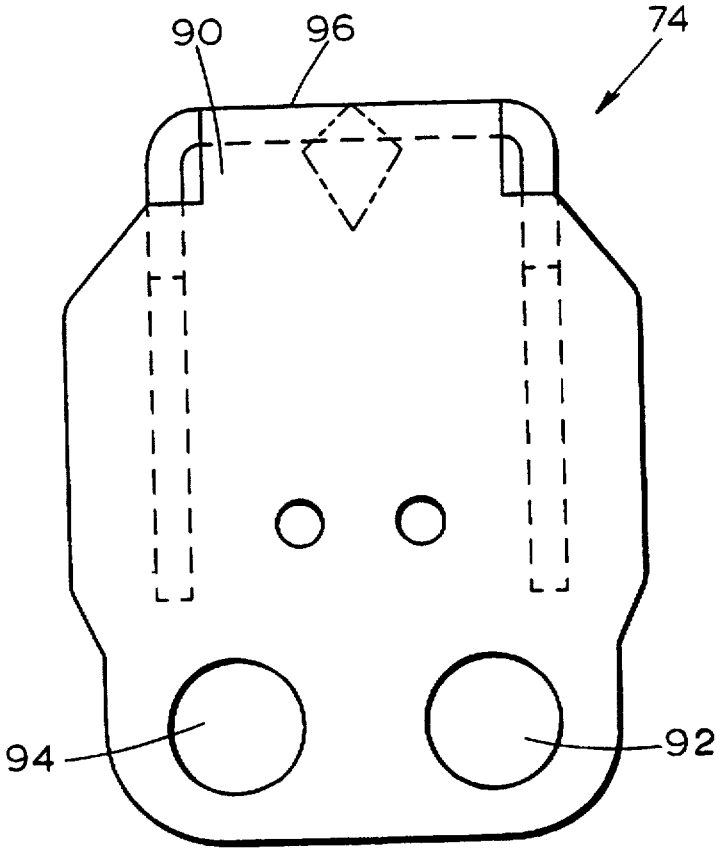
FIG. 4 is a top view of the support bracket shown in FIG. 3.
Figure 5:
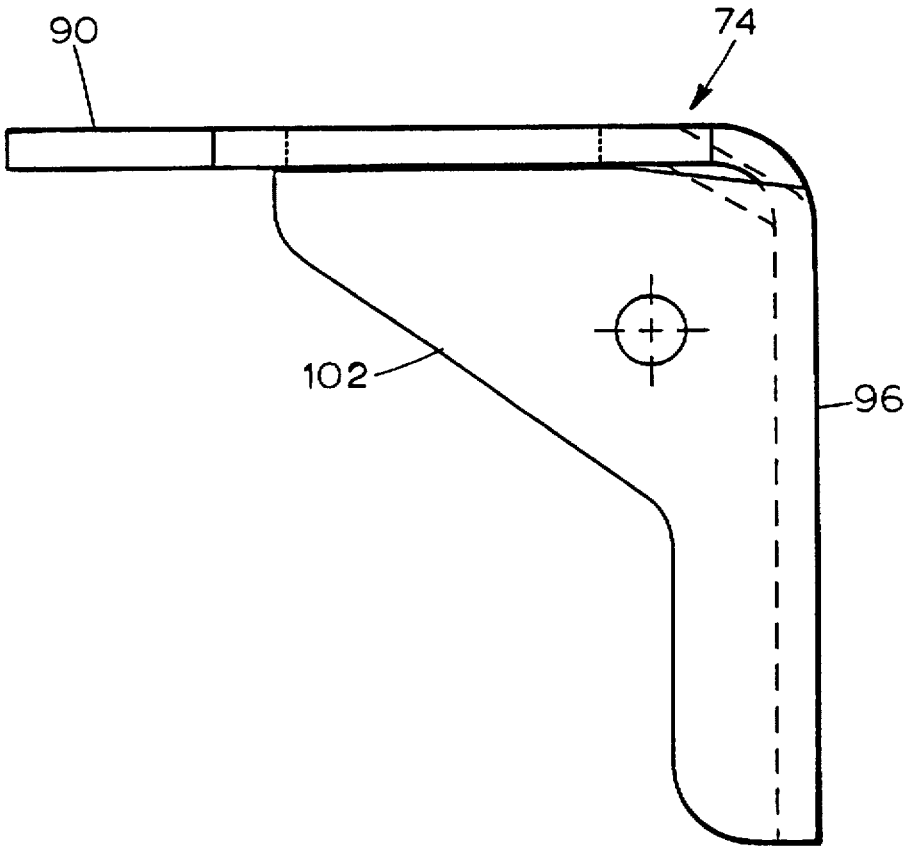
FIG. 5 a side view of the support bracket shown in FIG. 3.
Figure 6:
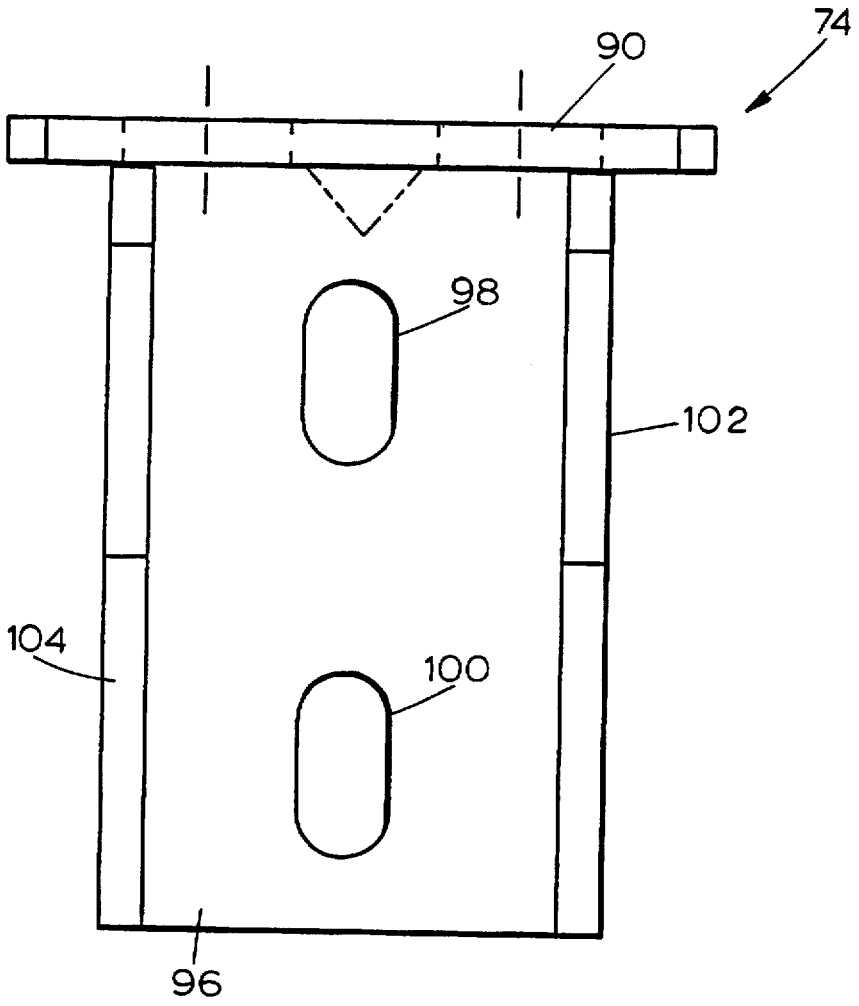
FIG. 6 is a front view of the support bracket shown in FIG. 3.

The support bracket 74 is shown in more detail in FIGS. 4, 5, and 6. The support bracket 74 has a bracket top 90 which has a pair of pin receiving holes 92 and 94 therethrough and which bears the weight of the first appliance door 14. The support bracket 74 has a bracket back 96 which, when the support bracket 74 is mounted to the footer 22, abuts the washer plate 72. A pair of elongated holes 98 and 100 through the bracket back 96 correspond to the elongated holes 82 and 84 of the washer plate 72 and the elongated holes 78 and 80 of the washer plate 70. Thus, when the fasteners 86 and 88 are inserted through the support bracket 74, they are inserted through the elongated holes 98 and 100. A pair of gussets 102 and 104 interconnect the bracket top 90 and the bracket back 96.

Figure 9:
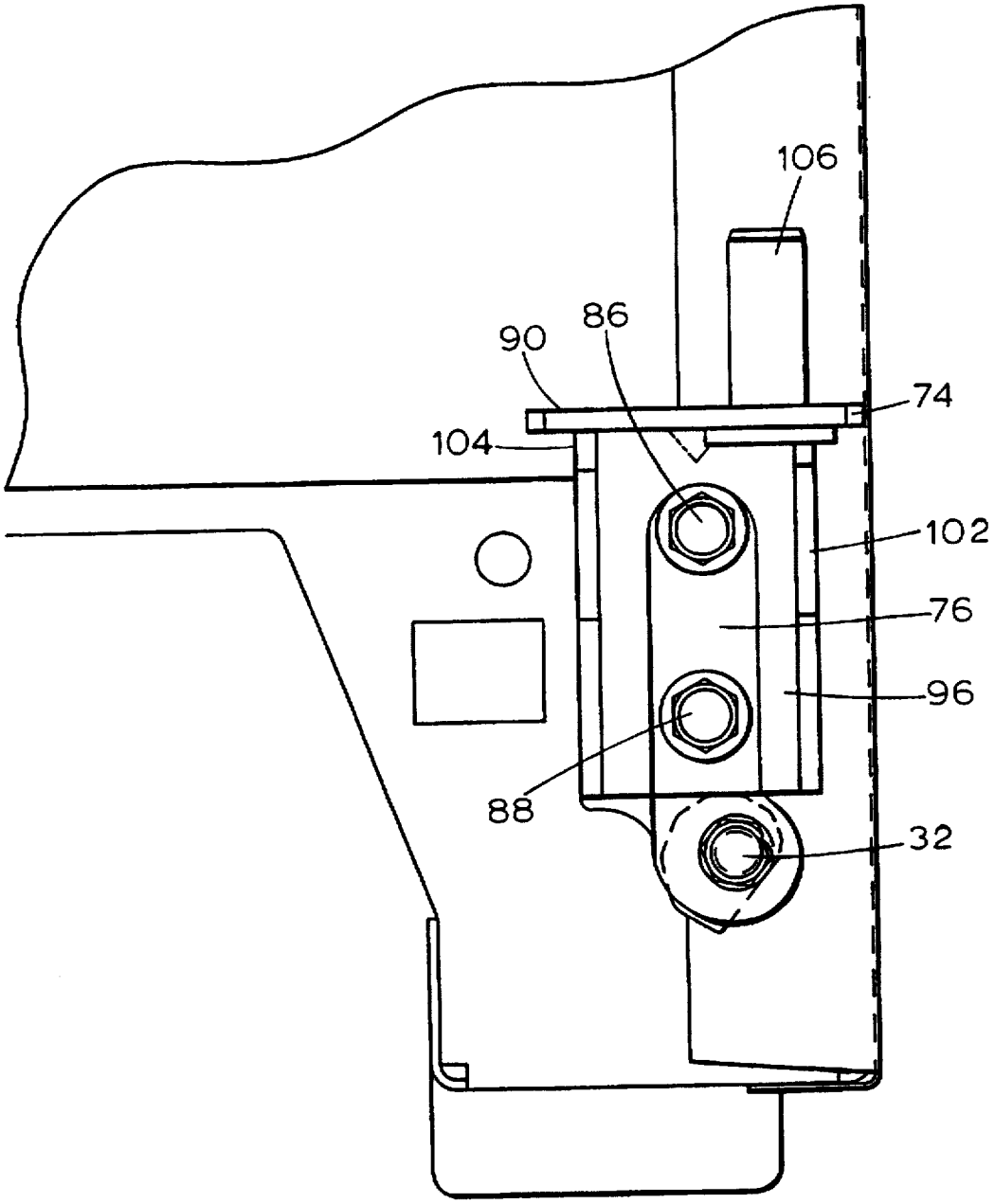
FIG. 9 is a front view of the vertical adjustment cam assembly as installed on the appliance shown in FIG. 1.

As shown in FIGS. 3 and 9, a pin 106 is held in the pin receiving hole 92 through the bracket top 90 of the support bracket 74. For example, the pin 106 may be pressed into the pin receiving hole 92, or the pin 106 may be held to the support bracket 74 by any other suitable means. When the first appliance door 14 is applied to the appliance cabinet 12, the first appliance door 14 is set down on bracket top 90 of the support bracket 74 so that the pin 106 enters a corresponding hole in the bottom of the first appliance door 14. Accordingly, the first appliance door 14 is supported by the support bracket 74, and the support bracket 74 forms a bottom hinge for the first appliance door 14.

Alternatively, the pin 106 may be held in the pin receiving hole 94 through the bracket top 90 of the support bracket 74 depending upon the desired horizontal position of first appliance door 14.

Figure 7:
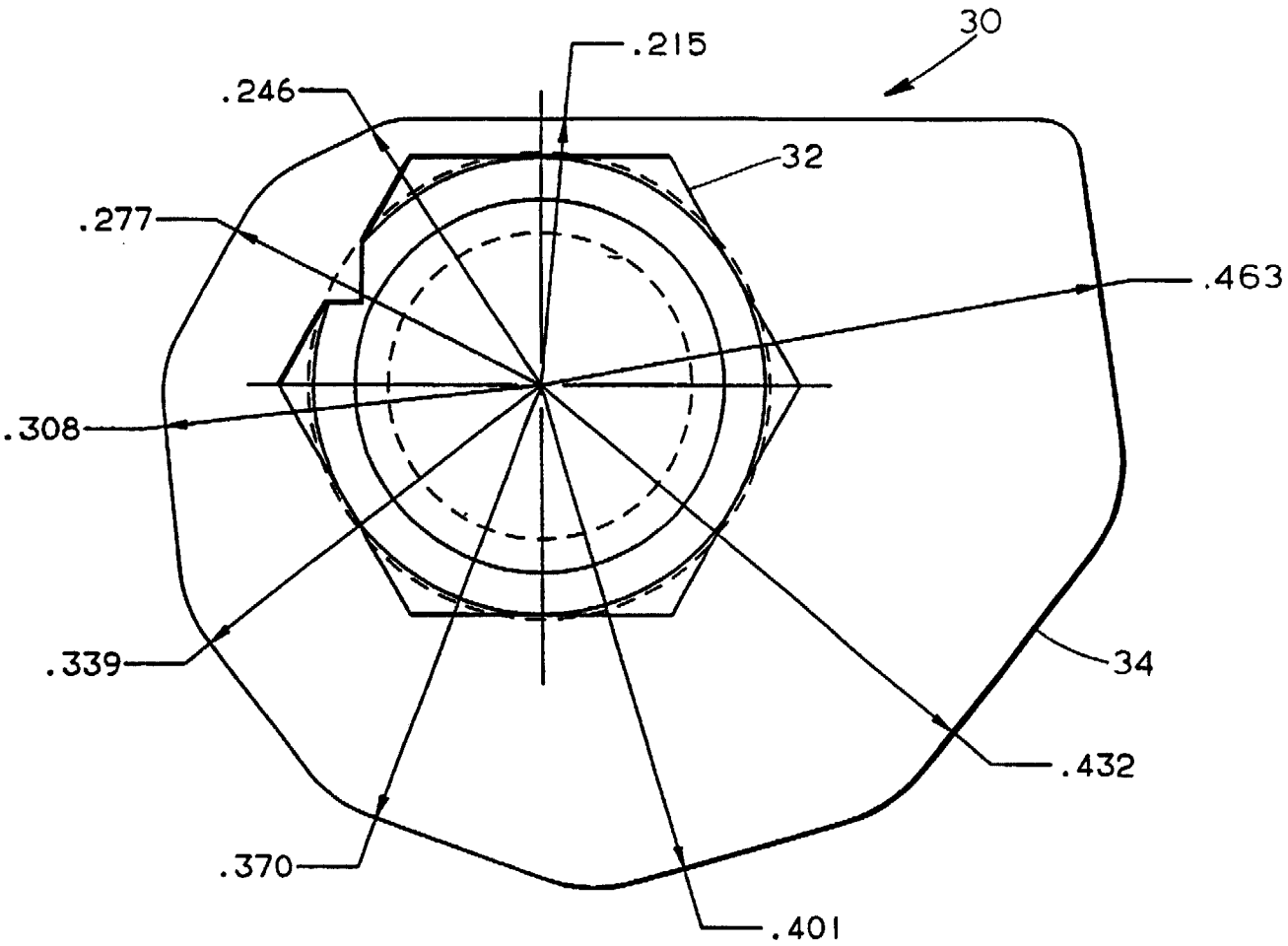
FIG. 7 is a front view of the adjustment cam shown in FIG. 2.

The cam surface 34, as shown in FIG. 7, may have a plurality of cam facets which are arranged eccentrically around the center of the adjustment head 32. Accordingly, as the adjustment head 32 is used to rotate the cam 30, the cam surface 34 presents a different cam facet to a bottom 108 of the support bracket 74. In this manner, the eccentricity of the cam surface 34 may be used to adjust the vertical position of the first appliance door 14.

In order to adjust the vertical position of the first appliance door 14 with respect to the second appliance door 16, the fasteners 86 and 88 are loosened to permit movement of the support bracket 74 by the cam 30. Also, although not shown, fasteners of a top hinge of the first appliance door 14 are similarly loosened or, alternatively, this top hinge may be arranged to allow vertical movement of the first appliance door 14 and the appliance cabinet 12 without requiring loosening of top hinge fasteners. A tool, such as a hex wrench, is then applied to the adjustment head 32 of the cam 30, and the cam 30 is rotated by use of the tool. As the cam 30 is rotated by the tool, the cam facets of the cam surface 34 are correspondingly rotated so that different cam facets abut the bottom 108 of the support bracket 74. As each cam facet contacts the bottom 108 of the support bracket 74, the vertical displacement of the first appliance door 14, which rests upon the support bracket 74, changes along the vertical axis of the appliance 10. The elongated holes 98 and 100 in the support bracket 74 accommodate vertical movement of the support bracket 74 and the first appliance door 14 with respect to the fasteners 86 and 88 as the cam 30 is rotated. When the first appliance door 14 is properly aligned with the second appliance door 16, the fasteners 86 and 88 tightened. Also, the fasteners of the top hinge of the first appliance door 14 are tightened, if necessary. The first appliance door 14 is thus held in its aligned position by the cam 30 and the support bracket 74.

Certain modifications of the present invention have been discussed above. Other modifications will occur to those practicing in the art of the present invention. For example, instead of rotating the cam 30 in order to vertically adjust the first appliance door 14, the cam 30 be arranged to be displaced perpendicularly into and out of the footer 22 so as to vertically adjust the first appliance door 14. For example, the cam 30 may have a conical cam surface so that, as the cam 30 is pushed into and out of the footer 22, the support bracket 74 rides up and down on the conical cam surface.

In addition, although the cam adjustment apparatus of the present invention has been described in relation to the vertical adjustment of a door of an appliance having side by side doors, the cam adjustment apparatus of the present invention may be used to adjust a door of an appliance having top and bottom doors. Moreover, the cam adjustment apparatus of the present invention may be used to adjust a door of an appliance having a single door so that the single door appears trim with the appliance cabinet.

Furthermore, instead of the cam surface 34 being a faceted surface as shown in the drawings, the cam surface 34 may instead be a smooth surface which is formed eccentrically about the center of the adjustment head 32. However, the advantage of a faceted cam surface is stability. That is, if the appliance whose support bracket rests on a flat cam facet is jostled, the adjustment cam is not likely to rotationally slip which would otherwise result in a change in the vertical displacement of the appliance door. However, if the support bracket rests on a smooth cam surface and if the adjustment cam slips, the vertical displacement of the appliance door changes.

Also, a second cam adjustment apparatus, similar to the cam adjustment apparatus 24, may be used to support the second appliance door 16. In this manner, the first and second appliance doors 14 and 16 may be adjusted with respect to each other, and both may be adjusted with respect to the appliance cabinet 12. Moreover, one or more cam adjustment apparatuses may be used to horizontally adjust a first appliance door and/or a second appliance door.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. An apparatus comprising:

a support, wherein the support is arranged to support an appliance door, wherein the support has a hole and wherein the hole is arranged to receive a mounting fastener that fastens the support to a base; and, a cam abutting the support, wherein the cam has a variable cam profile and is arranged to adjust a vertical position of the support, wherein the cam comprises a cam surface, a shoulder, and an adjustment head, wherein the shoulder is arranged to retain the cam on the base, wherein the cam surface abuts the support, wherein the cam surface may be moved by the adjustment head, and wherein the hole of the support is elongated so as to permit the cam to move the support with respect to the base.

2. The apparatus of claim 1 wherein the cam further comprises a cam shaft having first and second ends, wherein the cam surface and the adjustment head are at the first end of the cam shaft, and wherein the shoulder is at the second end of the cam shaft.

3. The apparatus of claim 2 further comprising a key slot, and wherein the key slot is arranged to receive the shoulder and shaft of the cam to permit the cam to be assembled to a base and to retain the cam on the base to which the cam is assembled.

4. The apparatus of claim 3 wherein the cam surface has a plurality of cam facets, wherein each cam facet corresponds to a different vertical position of the support, and wherein the cam facets are arranged so that they provide stability to each different vertical position of the support.

5. The apparatus of claim 1 wherein the cam has a plurality of cam facets, wherein each cam facet corresponds to a different vertical position of the support, and wherein the cam facets are arranged so that they provide stability to each different vertical position of the support.

6. An appliance having an appliance door which may be vertically adjusted with respect to an appliance cabinet comprising:

an appliance cabinet;

an appliance door having a vertical position with respect to the appliance cabinet;

supporting means for supporting the appliance door on the appliance cabinet;

a cam abutting the supporting means, wherein the cam has a variable cam profile, wherein the cam is arranged to adjust the vertical position of the appliance door with respect to the appliance cabinet, wherein the cam has a plurality of cam facets, wherein each cam facet corresponds to a different vertical position of the appliance door, and wherein the cam facets are arranged so that they provide stability to each different vertical position of the appliance door.

7. The appliance of claim 6 wherein the supporting means has a hole, wherein the hole is arranged to receive a mounting fastener that fastens the supporting means to the appliance cabinet, and wherein the hole is elongated so as to permit the supporting means to be moved vertically by the cam.

8. The appliance of claim 7 wherein the cam comprises:

a cam surface abutting the supporting means and having the variable profile; and, an adjustment head which is arranged to receive a tool so that the cam surface may be moved.

9. The appliance of claim 8 wherein the cam further comprises a shoulder which is arranged to retain the cam on the appliance.

10. The appliance of claim 9 wherein the cam further comprises a cam shaft having first and second ends, wherein the cam surface and the adjustment head are at the first end of the cam shaft, and wherein the shoulder is at the second end of the cam shaft.

11. The appliance of claim 10 wherein the supporting means further has a key slot therethrough, and wherein the key slot is arranged to receive the shoulder of the cam to permit the cam to be assembled to the appliance cabinet and to retain the cam on the appliance cabinet to which the cam is assembled.

12. The appliance of claim 6 wherein the cam further comprises:

a cam surface abutting the supporting means and having the variable profile; and, a shoulder which is arranged to retain the cam on the appliance cabinet.

13. The appliance of claim 12 wherein the supporting means has a key slot therethrough, and wherein the key slot is arranged to receive the shoulder of the cam to permit the cam to be assembled to the appliance cabinet and to retain the cam on the appliance cabinet to which the cam is assembled.

14. An apparatus for facilitating adjustment of an appliance door with respect to an appliance cabinet comprising:

a support bracket, wherein the support bracket is arranged to support an appliance door;

a cam abutting the support bracket, wherein the cam has a cam profile, wherein the cam is arranged to adjust the support bracket as the cam is moved so that a position of an appliance door is adjusted, wherein the cam has a plurality of cam facets, wherein each cam facet corresponds to a different position of an appliance door, and wherein the cam facets are arranged so that they provide stability to each different position of the appliance door; and, an attachment mechanism, wherein the attachment mechanism is arranged to attach the cam to an appliance cabinet so as to permit the cam to move and so as to permit the cam to adjust an appliance door with respect to its appliance cabinet.

15. The apparatus of claim 14 wherein the support bracket has a hole, wherein the hole is arranged to receive a mounting fastener that fastens the support bracket to an appliance, and wherein the hole is elongated so as to permit the support bracket to be moved by the cam.

16. The apparatus of claim 15 wherein the cam comprises:

a cam surface abutting the support bracket and having the variable profile; and, an adjustment head which is arranged to receive a tool so that the cam surface may be moved.

17. The apparatus of claim 16 wherein the cam further comprises a shoulder which is arranged to retain the cam on an appliance.

18. The apparatus of claim 17 wherein the cam further comprises a cam shaft having first and second ends, wherein the cam surface and the adjustment head are at the first end of the cam shaft, and wherein the shoulder is at the second end of the cam shaft.

19. The apparatus of claim 18 wherein the attachment mechanism comprises a key slot, and wherein the key slot is arranged to receive the shoulder of the cam to permit the cam to be assembled to an appliance and to retain the cam on the appliance to which the cam is assembled.

20. The apparatus of claim 14 wherein the cam further comprises:

a cam surface abutting the support bracket and having the variable profile; and, a shoulder which is arranged to retain the cam on an appliance.

21. The apparatus of claim 20 wherein the attachment mechanism comprises a key slot, and wherein the key slot is arranged to receive the shoulder of the cam to permit the cam to be assembled to an appliance and to retain the cam on the appliance to which the cam is assembled.

* * * * *